US008875984B2

(12) United States Patent
Leidal

(10) Patent No.: US 8,875,984 B2
(45) Date of Patent: Nov. 4, 2014

(54) KNOCK-DOWN PACKAGING APPARATUS

(71) Applicant: Minnesota Corrugated Box, Inc., Albert Lea, MN (US)

(72) Inventor: Greg Leidal, Albert Lea, MN (US)

(73) Assignee: Minnesota Corrugated Box, Inc., Albert Lea, MN (US)

( * ) Notice: Subject to any disclaimer, the term of this patent is extended or adjusted under 35 U.S.C. 154(b) by 0 days.

(21) Appl. No.: 14/206,830

(22) Filed: Mar. 12, 2014

(65) Prior Publication Data

US 2014/0263594 A1 Sep. 18, 2014

Related U.S. Application Data

(60) Provisional application No. 61/852,132, filed on Mar. 15, 2013.

(51) Int. Cl.

| | |
|---|---|
| ***B65D 5/496*** | (2006.01) |
| ***B65D 25/06*** | (2006.01) |
| ***B65D 5/66*** | (2006.01) |
| ***B65D 5/49*** | (2006.01) |
| ***B65D 5/44*** | (2006.01) |

(52) U.S. Cl.

CPC ..... *B65D 5/48024* (2013.01); *B65D 5/6626* (2013.01); *B65D 5/445* (2013.01)

USPC ..... 229/120.24; 229/117.07; 229/120.31; 229/199

(58) Field of Classification Search

USPC ..... 229/117.07, 120.24, 120.26, 120.28, 229/120.31, 120.33, 120.37, 199

See application file for complete search history.

(56) References Cited

U.S. PATENT DOCUMENTS

| | | | | | |
|---|---|---|---|---|---|
| 734,217 | A | * | 7/1903 | Bloomer | 229/117.07 |
| 2,012,954 | A | * | 9/1935 | Burns | 229/120.24 |
| 2,899,122 | A | * | 8/1959 | Schaefer | 229/117.07 |
| 3,102,674 | A | * | 9/1963 | Hamilton | 229/120.38 |
| 3,297,228 | A | | 1/1967 | Contratto | |
| 3,829,002 | A | * | 8/1974 | Kleinhaut | 229/199 |
| 4,089,458 | A | * | 5/1978 | Meyers et al. | 229/120.24 |
| 4,151,948 | A | | 5/1979 | de la Fuente, Jr. | |
| 4,375,263 | A | * | 3/1983 | Dworkin | 229/120.24 |
| 4,989,779 | A | | 2/1991 | Lashyro | |
| 5,004,146 | A | * | 4/1991 | Thominet et al. | 229/120.31 |
| 5,143,431 | A | * | 9/1992 | Udell | 229/120.24 |
| 5,335,845 | A | | 8/1994 | Liu | |
| 5,421,509 | A | * | 6/1995 | Thuin et al. | 229/117.07 |
| 5,516,034 | A | * | 5/1996 | Jensen et al. | 229/120.38 |
| 5,522,539 | A | * | 6/1996 | Bazany | 229/199 |
| 5,826,728 | A | | 10/1998 | Sheffer | |
| 6,471,121 | B1 | | 10/2002 | Nielsen | |
| 8,567,661 | B2 | * | 10/2013 | Sullivan et al. | 229/120.24 |

* cited by examiner

*Primary Examiner* — Gary Elkins

(74) *Attorney, Agent, or Firm* — Merchant & Gould P.C.

(57) ABSTRACT

The present disclosure relates to a packaging apparatus foldable between an expanded configuration and a collapsed configuration. The packaging apparatus includes a clam-shell style box including a main section and a cover section. The main section and the cover section are connected by a rear hinge panel. The main section includes a bottom panel, a left panel, a right panel and a front panel interconnected by fold lines. The cover section includes a top panel, a left panel, a right panel and a front panel interconnected by fold lines. The rear hinge panel is connected to the bottom panel at a lower fold line and is connected to the top panel at an upper fold line. Flaps of the front panel are adhesively bonded to the left and right panels. Angled perforations allow portions of the front panel to be folded down with the left and right panels when the box is moved to the collapsed configuration.

6 Claims, 8 Drawing Sheets

KNOCK-DOWN PACKAGING APPARATUS

CROSS-REFERENCE TO RELATED APPLICATION

The present patent application claims the benefit of U.S. Provisional Patent Application Ser. No. 61/852,132, filed Mar. 15, 2013, which application is hereby incorporated by reference in its entirety.

BACKGROUND

Numerous boxes and other containers for food have been developed. A number of these are simply six-walled boxes. Such boxes may also be compartmentalized by partitions to separate various foods or portions of foods. However, food containers can be limited in their ability to be easily assembled and can often include complex configurations with relatively large numbers of separate pieces. Some food containers are also limited in their ability to fold flat and also have structural integrity or strength.

Due to the above-described disadvantages, an improved container for food transport and storage is desired.

SUMMARY

Aspects of the present disclosure relates to a packaging apparatus including a clam-shell style box foldable between an expanded configuration and a collapsed configuration. The clam-shell style box includes a main section and a cover section. The main section and the cover section are connected by a rear hinge panel. The main section includes a bottom panel, a left panel, a right panel and a front panel interconnected by fold lines. The cover section includes a top panel, a left panel, a right panel and a front panel interconnected by fold lines. The rear hinge panel is connected to the bottom panel at a lower fold line and is connected to the top panel at an upper fold line. The packaging apparatus includes a reinforcing panel bonded to an inner surface of the rear hinge panel of the clam-shell style box such that the rear hinge panel has a double wall construction. The packaging apparatus includes a divider structure integrated within the clam-shell style box. The divider structure includes first and second divider panels and a base panel. The first and second divider panels are foldable relative to the base panel. The base panel is bonded to the bottom panel of the main section of the clam-shell style box. The base panel and the first and second divider panels have lengths that extend from the left panel to the right panel of the main section. The divider structure is foldable between a flat configuration and a dividing configuration. The first and second divider panels are upright and configured to divide the main section into a front compartment, a middle compartment and a rear compartment when the divider structure is in the dividing configuration and the clam-shell style box is in the expanded configuration. The first and second divider panels have lower tabs that fit within corresponding openings defined by the bottom panel when the divider structure is in the dividing configuration. The first and second divider panels include stabilizers formed by foldable left and right end flaps that are upright and that respectively oppose the left and right panels of the main section when the clam-shell style box is in the expanded configuration and the divider structure is in the dividing configuration.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
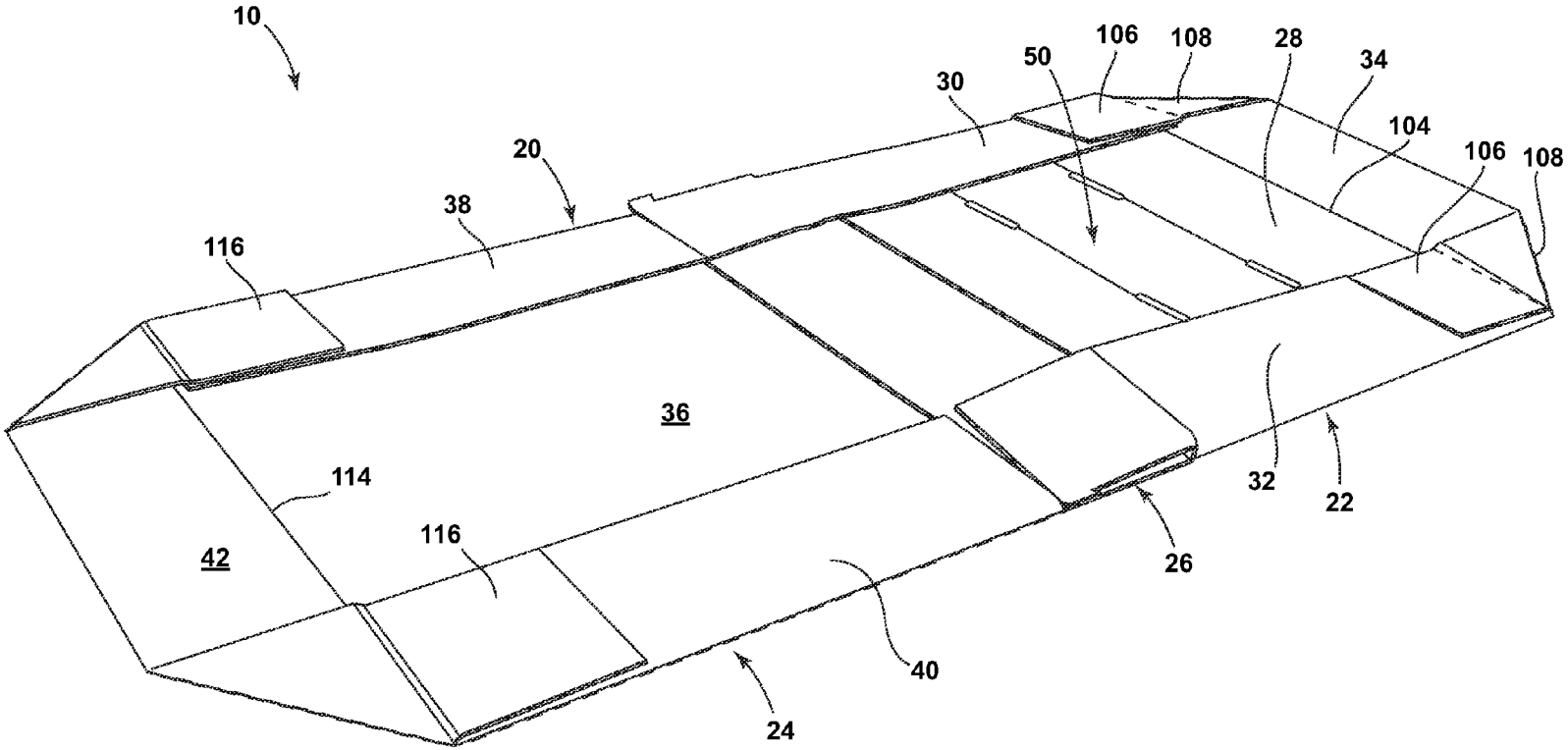
FIG. 1 is a perspective view of a packaging apparatus in accordance with the principles of the present disclosure, the apparatus is shown in a flat, knocked-down configuration in which all of the panels are generally parallel with respect to one another.
Figure 2:
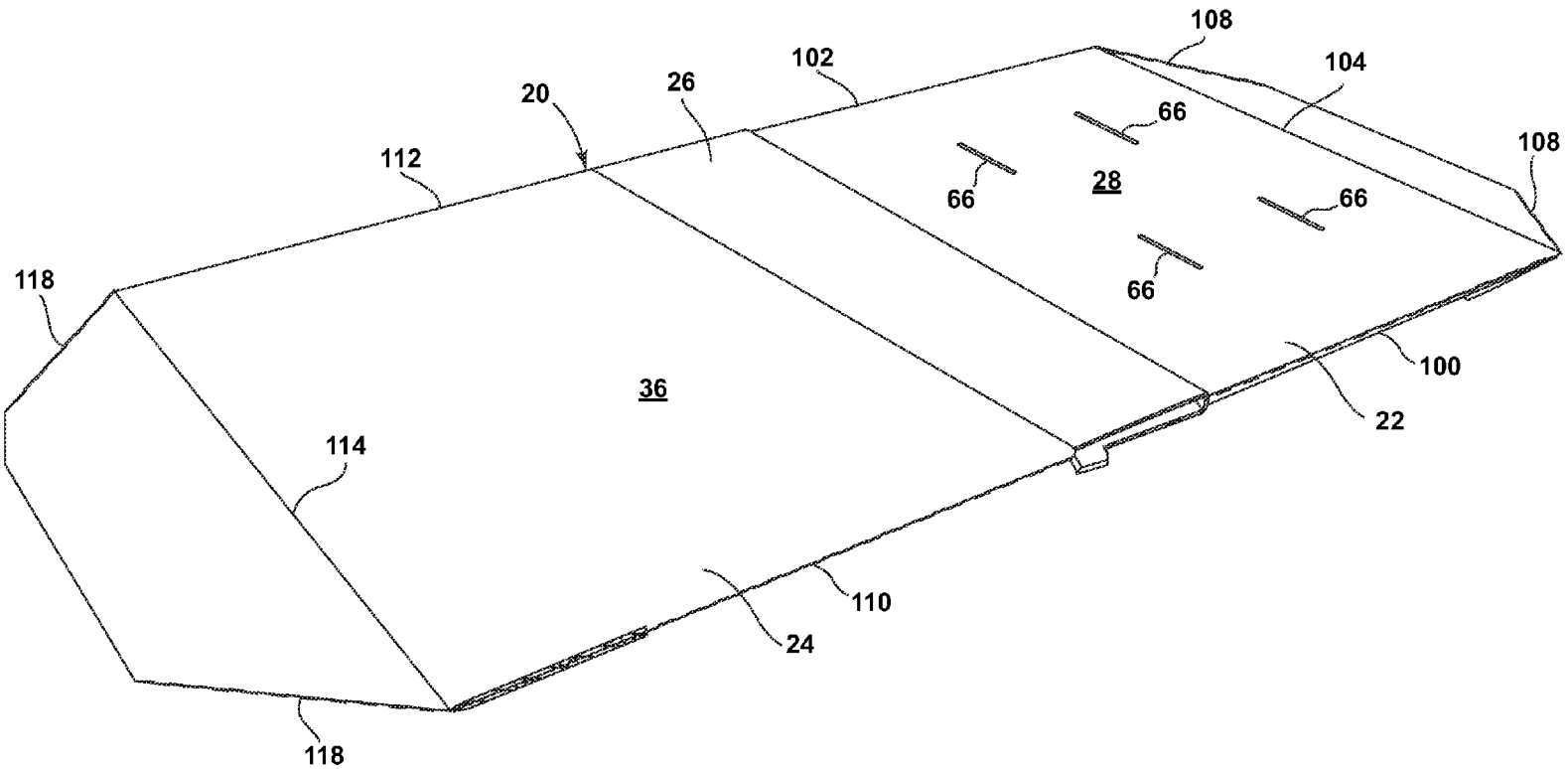
FIG. 2 shows an opposite side of the packaging apparatus of FIG. 1 while the apparatus remains in a knocked-down configuration.
Figure 3:
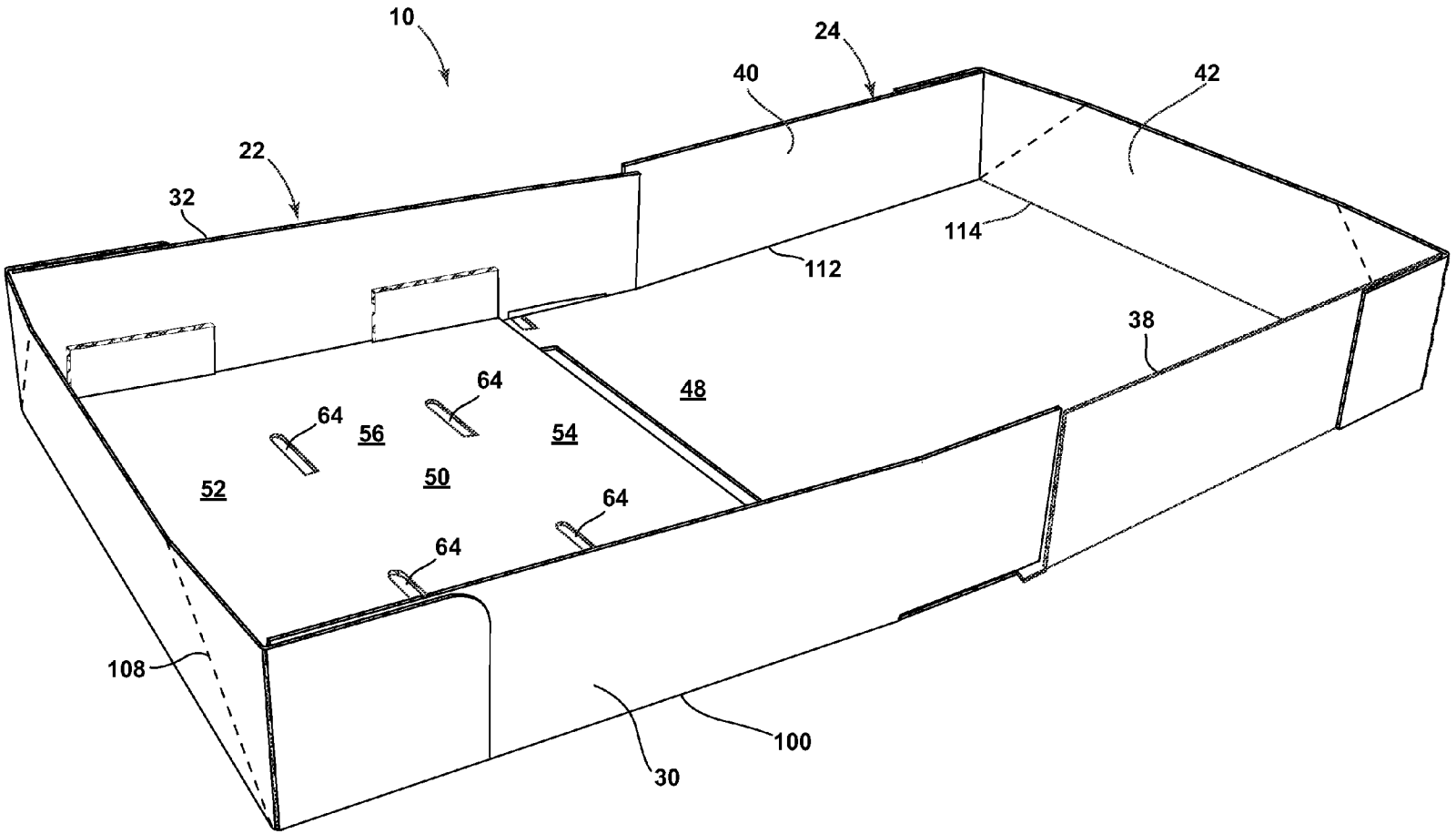
FIG. 3 shows the apparatus of FIG. 1 with the sidewalls folded upright.
Figure 4:
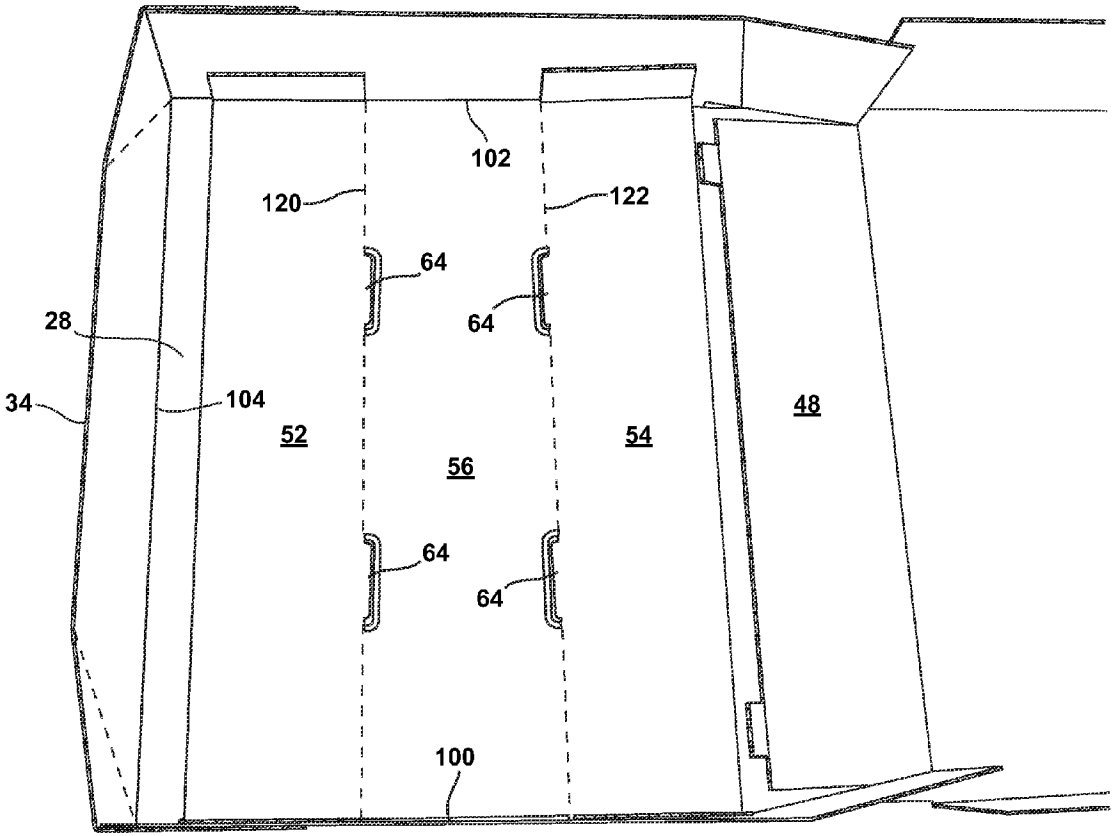
FIG. 4 shows a main section of the apparatus of FIG. 1 with the sidewalls folded upright and a divider structure oriented in a flat configuration within the main section.
Figure 5:
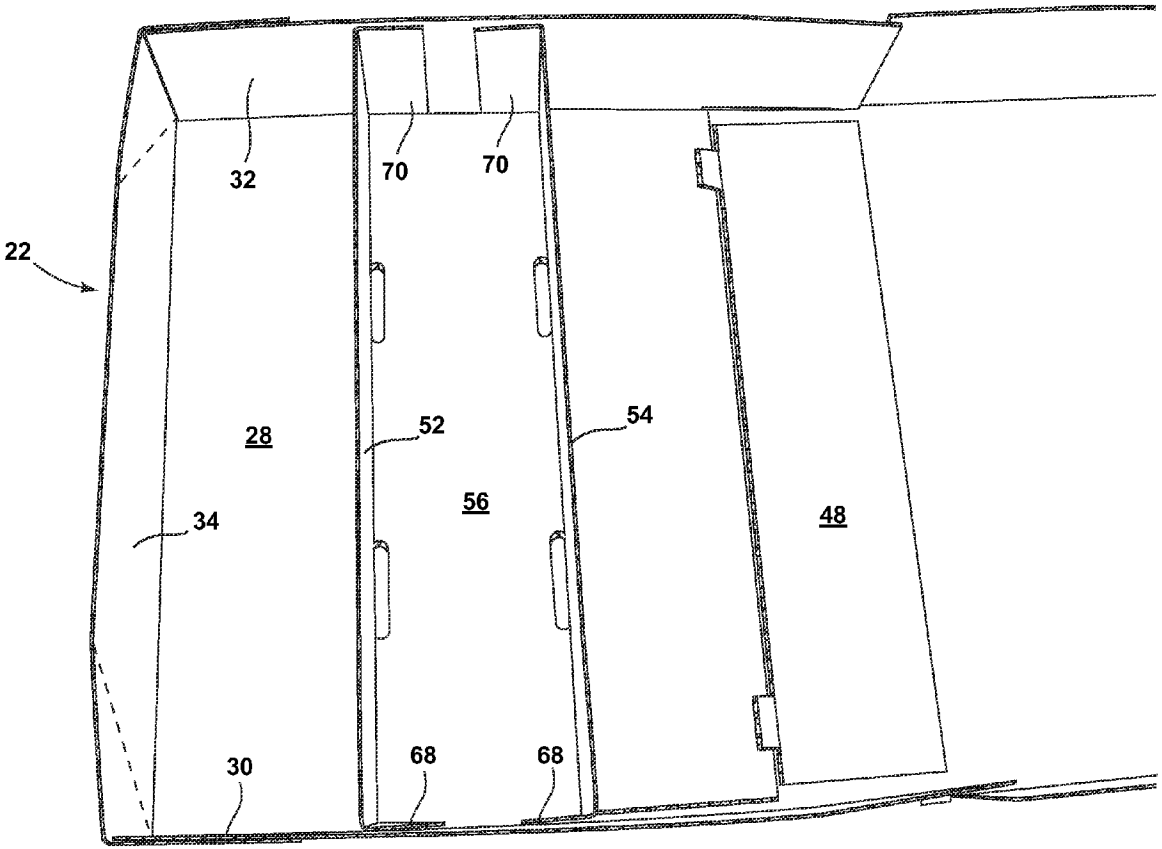
FIG. 5 shows the main section of FIG. 4 with the divider structure folded to a dividing configuration.
Figure 6:
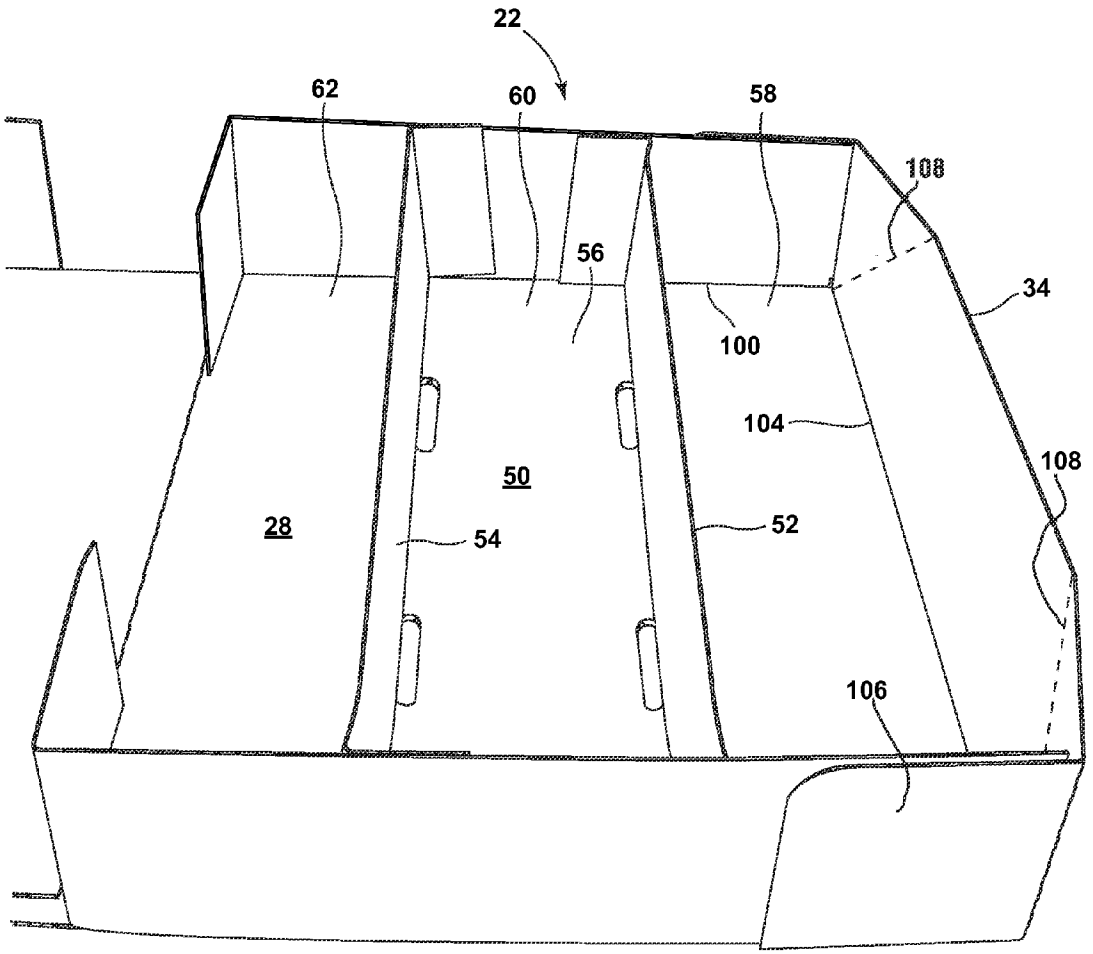
FIG. 6 is another view of the main section of FIGS. 4 and 5 with the divider section in the dividing configuration.
Figure 7:
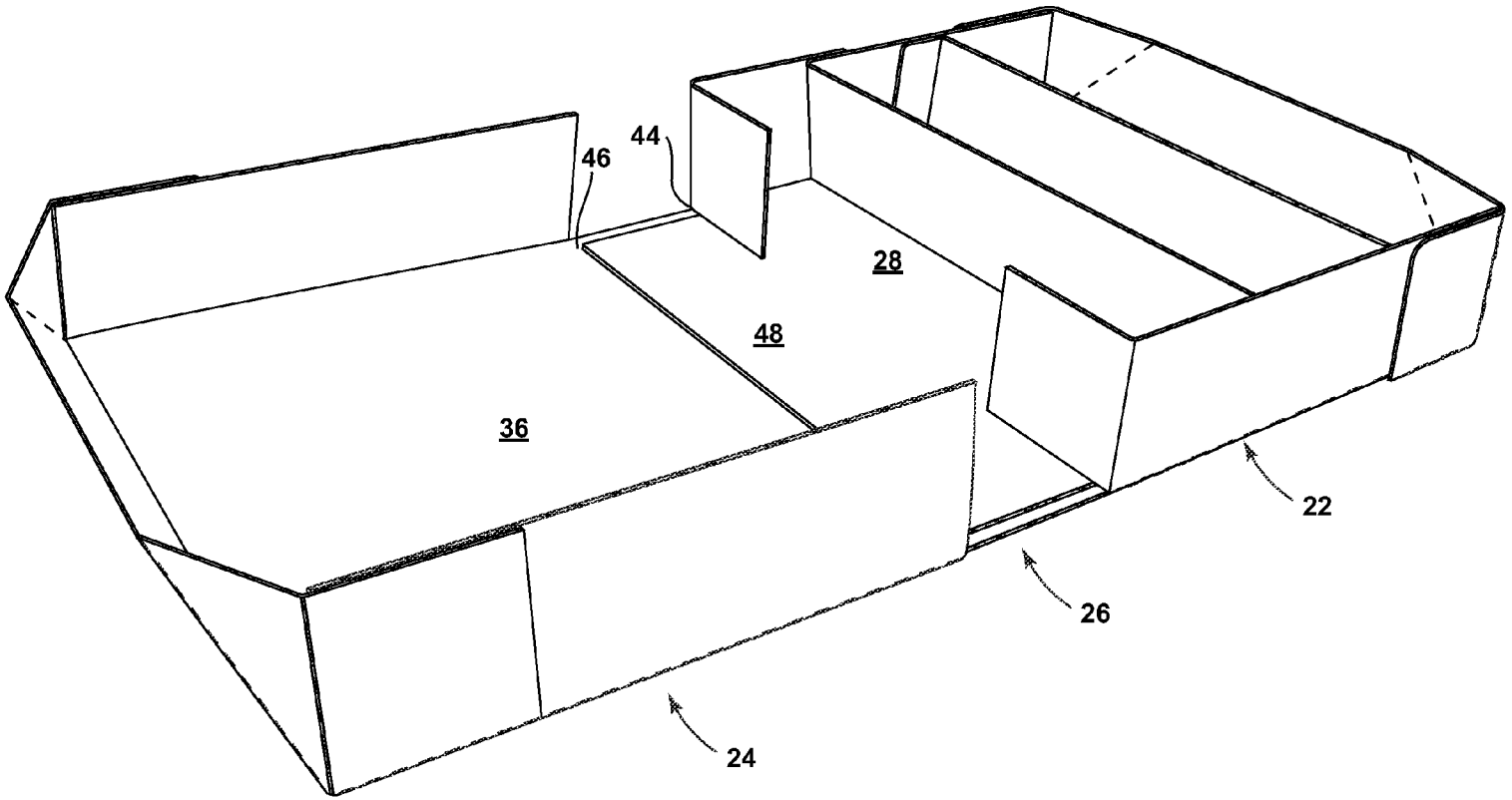
FIG. 7 is a perspective view of the apparatus of FIGS. 1-6 in an expanded, open configuration.
Figure 8:
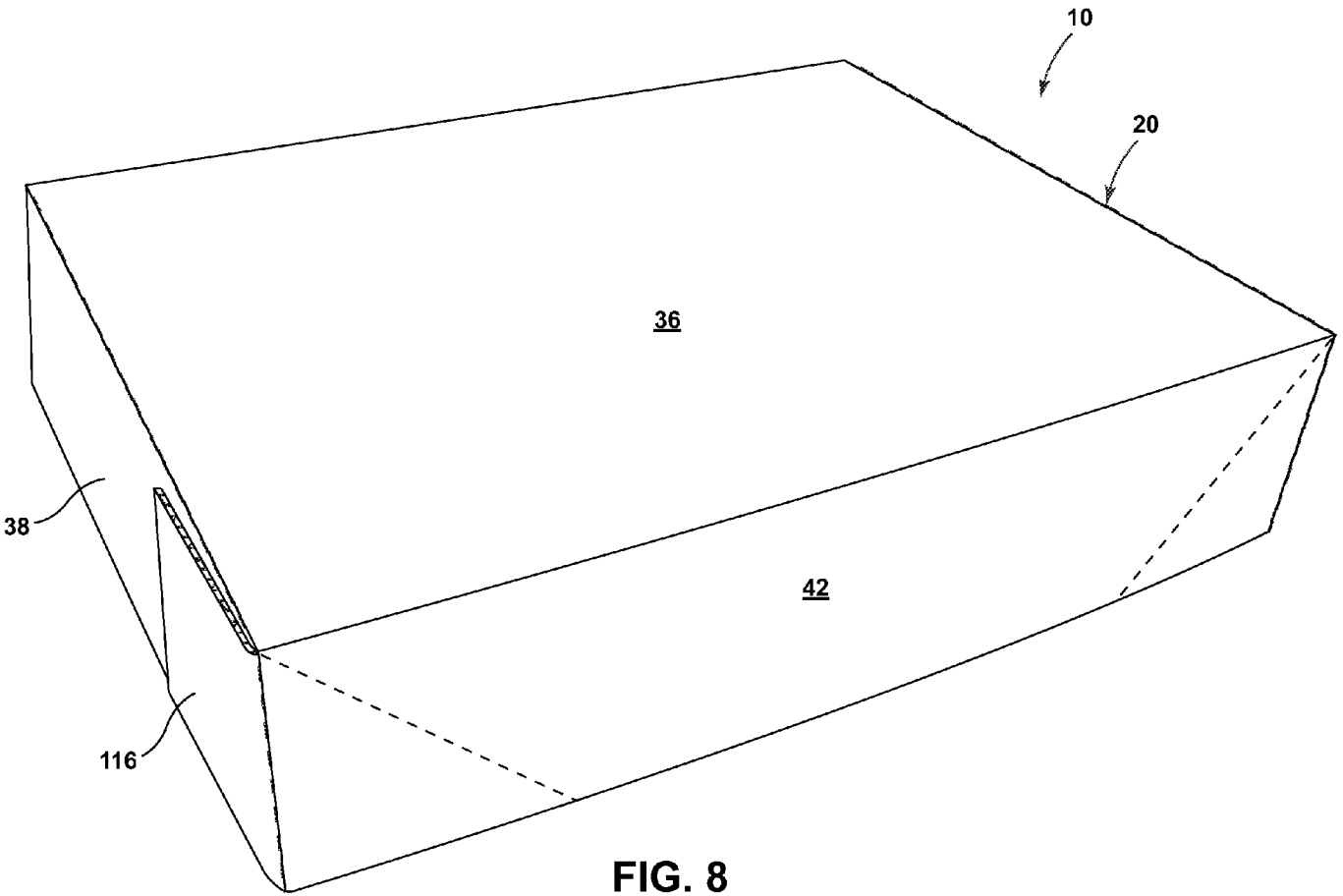
FIG. 8 is a perspective view of the apparatus of FIGS. 1-7 shown in an expanded, closed configuration.

FIGS. 1-8 show a packaging apparatus 10 in accordance with the principles of the present disclosure. The packaging apparatus 10 is foldable between an expanded configuration (see FIGS. 7 and 8) and a collapsed configuration (see FIGS. 1 and 2). The packaging apparatus 10 includes a clam-shell style box 20 including a main section 22 and a cover section 24. The main section 22 and the cover section 24 are connected by a rear hinge panel 26. The main section 22 includes a bottom panel 28, a left panel 30, a right panel 32 and a front panel 34. The left panel 30 connects to the bottom panel 28 at fold line 100, the right panel 32 connects to the bottom panel 28 at fold line 102 and the front panel 34 connects to the bottom panel 28 at fold line 104. Flaps 106 of the front panel 34 are adhesively bonded to the left and right panels 30, 32. Angled perforations 108 allow portions of the front panel 34 to be folded down with the left and right panels 30, 32 when the box 20 is moved to the collapsed configuration.

The cover section 24 includes a top panel 36, a left panel 38, a right panel 40 and a front panel 42. The left panel 38 connects to the top panel 36 at fold line 110, the right panel 40 connects to the top panel 36 at fold line 112 and the front panel 42 connects to the top panel 36 at fold line 114. Flaps 116 of the front panel 42 are adhesively bonded to the left and right panels 38, 40. Angled perforations 118 allow portions of the front panel 42 to be folded down with the left and right panels 38, 40 when the box 20 is moved to the collapsed configuration.

The rear hinge panel 26 is connected to the bottom panel 28 at a lower fold line 44 and is connected to the top panel 36 at an upper fold line 46. A reinforcing panel 48 (i.e., pad) is bonded to an inner surface of the rear hinge panel 26 such that the rear side of the box 20 is provided with a double wall construction. The reinforcing panel 48 is substantially the same size as the hinge panel 26. When the box 20 is in the expanded, closed configuration of FIG. 8, all four vertical sides of the box 20 are provided with a double wall construction. For example, reinforcing panel 48 and the rear hinge panel 26 provide a double wall at the rear of the box. Also, the left panels 30, 38 provide a double wall construction at the left side of the box. Further, the right panels 32, 40 provide a double wall construction at the right side of the box. Furthermore, the front panels 34, 42 provide a double wall construction at the front of the box. In certain examples, the box 20 can be configured to withstand over 500 lbs. or 600 lbs. of vertical compression when in the expanded, closed configuration.

The packaging apparatus 10 further includes a divider structure 50 integrated within the clam-shell style box 20. The divider structure 50 includes first and second divider panels 52, 54 and a base panel 56. The first and second divider panels 52, 54 are foldable relative to the base panel 56 at fold lines 120, 122. The fold lines 120, 122 can be perforated to facilitate folding. The base panel 56 is adhesively bonded to the bottom panel 28 of the main section 22 of the box 20. The base panel 56 and the first and second divider panels 52, 54 have lengths that extend from the left panel 30 to the right panel 32 of the main section 22. The divider structure 50 is foldable between a flat configuration (see FIGS. 3 and 4) and a dividing configuration (see FIGS. 5-7). The first and second divider panels 52, 54 are upright and configured to divide the main section 22 into a front compartment 58, a middle compartment 60 and a rear compartment 62 when the divider structure is in the dividing configuration and the box is in the expanded configuration. The first and second divider panels 52, 54 can include lower tabs 64 that fit within corresponding openings 66 defined by the bottom panel 28 when the divider structure 50 is in the dividing configuration. The first and second divider panels 52, 54 can also include stabilizers formed by foldable left and right flaps 68, 70 that are upright and respectively oppose the left and right panels 30, 32 of the main section 22 when the box 20 is in the expanded configuration and the divider structure 50 is in the dividing configuration.

In certain examples of the present disclosure, the packaging apparatus 10 can have a loaded weight in excess of 40 lbs. or 50 lbs. In certain examples, the packaging apparatus can be used to package meat products such as pork tenderloins. In certain examples, the various panels of the packaging apparatus can have a corrugated panel construction. In certain examples, the box portion of the packaging apparatus can be manufactured from one unitary/integrated piece of material (e.g., one blank of corrugated material). In another example, the divider structure and the reinforcing panel can be manufactured from one integral/unitary piece of material (e.g., one blank of corrugated material).

Various modifications and alterations of this disclosure will become apparent to those skilled in the art without departing from the scope and spirit of this disclosure, and it should be understood that the scope of this disclosure is not to be unduly limited to the illustrative examples as set forth herein.

What is claimed is:

1. A packaging apparatus comprising:

a clam-shell style box foldable between an expanded configuration and a collapsed configuration, the clam-shell style box including a main section and a cover section, the main section and the cover section being connected by a rear hinge panel, the main section including a bottom panel, a left panel, a right panel and a front panel interconnected by fold lines, the cover section including a top panel, a left panel, a right panel and a front panel interconnected by fold lines, the rear hinge panel being connected to the bottom panel at a lower fold line and being connected to the top panel at an upper fold line;

a reinforcing panel bonded to an inner surface of the rear hinge panel of the clam-shell style box such that the rear hinge panel has a double wall construction; and a divider structure integrated within the clam-shell style box, the divider structure including first and second divider panels and a base panel, the first and second divider panels being foldable relative to the base panel, the base panel being bonded to the bottom panel of the main section of the clam-shell style box, the base panel and the first and second divider panels having lengths that extend from the left panel to the right panel of the main section, the divider structure being foldable between a flat configuration and a dividing configuration, the first and second divider panels being upright and being configured to divide the main section into a front compartment, a middle compartment and a rear compartment when the divider structure is in the dividing configuration and the clam-shell style box is in the expanded configuration, the first and second divider panels having lower tabs that fit within corresponding openings defined by the bottom panel when the divider structure is in the dividing configuration, the first and second divider panels including stabilizers formed by foldable left and right end flaps that are upright and that respectively oppose the left and right panels of the main section when the clam-shell style box is in the expanded configuration and the divider structure is in the dividing configuration.

2. The packaging apparatus of claim 1, wherein the packaging apparatus has a loaded weight capacity in excess of 40 lbs.

3. The packaging apparatus of claim 1, wherein the packaging apparatus has a loaded weight capacity in excess of 50 lbs.

4. The packaging apparatus of claim 1, wherein various panels of the packaging apparatus have a corrugated panel construction.

5. The packaging apparatus of claim 1, wherein the packaging apparatus is used to package meat products.

6. The packaging apparatus of claim 5, wherein the meat products are pork tenderloins.

* * * * *